US010273554B2

(12) United States Patent
Shibata et al.

(10) Patent No.: US 10,273,554 B2
(45) Date of Patent: Apr. 30, 2019

(54) HOT-ROLLED STEEL SHEET AND METHOD OF MANUFACTURING THE SAME

(71) Applicant: JFE Steel Corporation, Tokyo (JP)

(72) Inventors: Tomoaki Shibata, Tokyo (JP); Sota Goto, Tokyo (JP)

(73) Assignee: JFE Steel Corporation (JP)

( * ) Notice: Subject to any disclaimer, the term of this patent is extended or adjusted under 35 U.S.C. 154(b) by 159 days.

(21) Appl. No.: 15/038,616

(22) PCT Filed: Nov. 20, 2014

(86) PCT No.: PCT/JP2014/005836

§ 371 (c)(1),
(2) Date: May 23, 2016

(87) PCT Pub. No.: WO2015/079661

PCT Pub. Date: Jun. 4, 2015

(65) Prior Publication Data

US 2016/0289788 A1 Oct. 6, 2016

(30) Foreign Application Priority Data

Nov. 28, 2013 (JP) ..... 2013-245616

(51) Int. Cl.

| | |
|---|---|
| ***C21D 6/00*** | (2006.01) |
| ***C21D 8/02*** | (2006.01) |
| ***C21D 9/46*** | (2006.01) |
| ***C22C 38/38*** | (2006.01) |
| ***C22C 38/58*** | (2006.01) |
| ***C21D 8/06*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |

(Continued)

(52) U.S. Cl.

CPC ..... *C21D 9/46* (2013.01); *C21D 6/005* (2013.01); *C21D 6/008* (2013.01); *C21D 8/02* (2013.01); *C21D 8/0226* (2013.01); *C21D 8/0263* (2013.01); *C21D 8/065* (2013.01); *C21D 9/08* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 2211/001; C21D 2211/002; C21D 2211/005; C21D 2211/008; C21D 6/005; C21D 6/008; C21D 8/02; C21D 8/0226; C21D 8/0263; C21D 8/065; C21D 9/08; C21D 9/46; C22C 38/001; C22C 38/002; C22C 38/02; C22C 38/04; C22C 38/06; C22C 38/22; C22C 38/24; C22C 38/26; C22C 38/32; C22C 38/38; C22C 38/42; C22C 38/44; C22C 38/46; C22C 38/48; C22C 38/50; C22C 38/54; C22C 38/58

See application file for complete search history.

(56) References Cited

U.S. PATENT DOCUMENTS

| | | | |
|---|---|---|---|
| 2011/0284137 | A1 | 11/2011 | Kami et al. |
| 2014/0290807 | A1 | 10/2014 | Goto et al. |

FOREIGN PATENT DOCUMENTS

| | | |
|---|---|---|
| CN | 1639375 | 7/2005 |
| CN | 101541992 | 9/2009 |

(Continued)

OTHER PUBLICATIONS

Supplementary European Search Report dated Sep. 7, 2016, of corresponding European Application No. 14866276.0.

(Continued)

*Primary Examiner* — Colleen P Dunn
*Assistant Examiner* — Anthony M Liang
(74) *Attorney, Agent, or Firm* — DLA Piper LLP (US)

(57) ABSTRACT

A hot-rolled steel sheet has a chemical composition containing, by mass %, C: 0.030% or more and 0.120% or less, Si: 0.05% or more and 0.50% or less, Mn: 1.00% or more and 2.20% or less, P: 0.025% or less, S: 0.0050% or less, N: 0.0060% or less, Al: 0.005% or more and 0.100% or less, Nb: 0.020% or more and 0.100% or less, Mo: 0.05% or more and 0.50% or less, Ti: 0.001% or more and 0.100% or less, Cr: 0.05% or more and 0.50% or less, Ca: 0.0005% or more and 0.0050% or less, and the balance being Fe and inevitable impurities, and has a microstructure including bainitic ferrite as a main phase and martensite and retained austenite as second phases, wherein a volume fraction of the main phase is 90% or more, an average grain diameter of the main phase is 10 μm or less, a volume fraction of the martensite is 0.5% or more and 9.5% or less, and a volume fraction of the retained austenite is 0.5% or more and 9.5% or less, wherein the steel sheet has a yield ratio of 90% or less, a yield strength of 555 MPa or more, and a tensile strength of 650 MPa or more.

4 Claims, No Drawings

(51) Int. Cl.

| | |
|---|---|
| ***C22C 38/32*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/42*** | (2006.01) |

(56) References Cited

FOREIGN PATENT DOCUMENTS

| | | | |
|---|---|---|---|
| EP | 1 504 134 | | 2/2005 |
| EP | 2 105 514 | | 9/2009 |
| EP | 2 692 902 | | 2/2014 |
| EP | 2 728 029 | | 5/2014 |
| JP | 63-227715 | A | 9/1988 |
| JP | 11-335735 | | 12/1999 |
| JP | 2006-274338 | | 10/2006 |
| JP | 2006-299413 | A | 11/2006 |
| JP | 2006-299414 | A | 11/2006 |
| JP | 2008-169475 | | 7/2008 |
| JP | 2010-196165 | A | 9/2010 |
| JP | 2012-172256 | A | 9/2012 |
| JP | 2012-188731 | A | 10/2012 |
| JP | 2012-214883 | | 11/2012 |
| JP | 2013-11005 | | 1/2013 |
| JP | 2013-139630 | | 7/2013 |
| JP | 2013-155390 | | 8/2013 |
| JP | 2013-204103 | A | 10/2013 |
| WO | 96/01708 | | 1/1996 |

OTHER PUBLICATIONS

Taiwanese Office Action dated Feb. 22, 2016, of corresponding Taiwanese Application No. 103141182, along with a Search Report in English.

Office Action dated Apr. 10, 2017, of corresponding Korean Application No. 10-2016-7016868, along with a Concise Statement of Relevance of Office Action in English.

Korean Notice of Allowance dated Oct. 17, 2017, of corresponding Korean Application No. 10-2016-7016866, along with an English translation.

Chinese Office Action dated Jan. 11, 2017, of corresponding Chinese Application No. 201480064978.2, along with a Search Report in English.

HOT-ROLLED STEEL SHEET AND METHOD OF MANUFACTURING THE SAME

TECHNICAL FIELD

This disclosure relates to a high-strength hot-rolled steel sheet with a low yield ratio excellent in terms of stability of properties after processing has been performed which can preferably be used as a material for a steel pipe for use in, for example, pipelines, oil country tubular goods, civil engineering and construction and, in particular, for a steel pipe of grade X80 specified in the API Standards and to a method of manufacturing the steel sheet.

BACKGROUND

With the globally growing trend away from nuclear power generation, it is expected that there will be a further growing demand for fossil energy in the future. Accordingly, it is assumed that there will be a growing demand for high-strength linepipes having a large diameter and a thick wall to increase transportation efficiency of natural gases and oils. To date, UOE steel pipes manufactured from thick steel plates have been mainly used as linepipes for high-pressure operation. Nowadays, however, since there is a strong demand to decrease the material costs of steel pipes, for example, to decrease the construction costs of pipelines and due to insufficient supply capacity of UOE steel pipes, there is a trend toward using electric resistance welded steel pipes and spiral steel pipes manufactured from hot-rolled steel sheets with higher productivity and lower cost than UOE steel pipes.

Pipelines are constructed in cold areas having, for example, large natural gas reserves in many cases. Therefore, steel sheets as a material for linepipes are required to have excellent low-temperature toughness as well as high strength. In addition, linepipes laid over a long distance tend to be affected by crustal movement. To prevent pipes from bursting due to pressure fluctuations therein when a pipeline fractures and the leakage of the transported gas occurs by some chance due to forced deformation caused by crustal movement, steel pipes are required to have deformability in the circumferential direction thereof, that is, a stably low yield ratio.

In such a situation, various techniques regarding a hot-rolled steel sheet as a material for a linepipe have been proposed. For example, Japanese Unexamined Patent Application Publication No. 63-227715 proposes a technique of manufacturing a hot-rolled steel sheet including heating a steel slab having a chemical composition containing C: 0.03 wt % to 0.12 wt %, Si: 0.50 wt % or less, Mn: 1.70 wt % or less, P: 0.025 wt % or less, S: 0.025 wt % or less, Al: 0.070 wt % or less, and at least one of Nb: 0.01 wt % to 0.05 wt %, V: 0.01 wt % to 0.02 wt %, and Ti: 0.01 wt % to 0.20 wt % to a temperature of 1180° C. to 1300° C., then performing hot rolling with a rough rolling finishing temperature of 950° C. to 1050° C. and a finish rolling temperature of 760° C. to 800° C., performing cooling at a cooling rate of 5° C./s to 20° C./s, starting air cooling at a temperature higher than 670° C., continuing air cooling for 5 seconds to 20 seconds, then performing cooling at a cooling rate of 20° C./s or more, and performing coiling at a temperature of 500° C. or lower. In addition, Japanese Unexamined Patent Application Publication No. 63-227715 states that, by using the manufacturing method described above, it is possible to manufacture a hot-rolled steel sheet having a tensile strength of 60 kg/mm$^2$ or more (590 MPa or more), a low yield ratio of 85% or less, and a low-temperature toughness corresponding to a ductile-brittle transition temperature of −60° C. or lower.

In addition, Japanese Unexamined Patent Application Publication No. 2006-299413 proposes a technique including hot-rolling a slab having a chemical composition containing, by mass %, C: 0.01% to 0.09%, Si: 0.50% or less, Mn: 2.5% or less, Al: 0.01% to 0.10%, Nb: 0.005% to 0.10%, and one, two, or more of Mo: 0.5% or less, Cu: 0.5% or less, Ni: 0.5% or less, Cr: 0.5% or less, in which Mneq (Mneq (%)=Mn+0.26Si+3.5P+1.30Cr+0.37Ni+2.67Mo), which is a relational expression of the contents of Mn, Si, P, Cr, Ni, and Mo, satisfies 2.0 or more, cooling the hot-rolled steel sheet to a temperature of 500° C. to 650° C. at a cooling rate of 5° C./s or more, coiling the cooled steel sheet, holding the coiled steel sheet in this temperature range for 10 minutes or more, then cooling the held steel sheet to a temperature lower than 500° C. to obtain a hot-rolled steel sheet, and forming the obtained hot-rolled steel sheet into a pipe to obtain an electric resistance welded steel pipe. In addition, Japanese Unexamined Patent Application Publication No. 2006-299413 states that, by manufacturing a hot-rolled steel sheet by using the method described above, it is possible to obtain a hot-rolled steel sheet having a microstructure including bainitic ferrite as a main phase, 3 vol % or more of martensite, and 1 vol % or more of retained austenite as needed, and that by forming the obtained hot-rolled steel sheet into a pipe, it is possible to manufacture an electric resistance welded steel pipe having a low yield ratio of 85% or less, a low-temperature toughness corresponding to a ductile-brittle transition temperature of −50° C. or lower, and excellent plastic-deformation-absorbing capability.

In addition, Japanese Unexamined Patent Application Publication No. 2012-172256 proposes a technique including controlling the chemical composition of a hot-rolled steel sheet to be one containing, by mass %, C: 0.03% to 0.11%, Si: 0.01% to 0.50%, Mn: 1.0% to 2.2%, P: 0.025% or less, S: 0.005% or less, Al: 0.005% to 0.10%, Nb: 0.01% to 0.10%, Ti: 0.001% to 0.05%, B: 0.0005% or less, one, two, or all of Cr: 0.01% to 1.0%, Mo: 0.01% to 0.5%, and Ni: 0.01% to 0.5%, and the balance being Fe and inevitable impurities, in which Mneq (Mneq (%)=Mn+0.26Si+1.30Cr+2.67Mo+0.8Ni), which is a relational expression of the contents of Mn, Si, Cr, Mo, and Ni, falls within a range of 2.0% to 4.0%, and controlling the microstructure of the hot-rolled steel sheet to be one including bainitic ferrite as a main phase, and at least 3.0%, in terms of area ratio, of martensite as a second phase, in which the average grain diameter of the bainitic ferrite is 10 μm or less. In addition, Japanese Unexamined Patent Application Publication No. 2012-172256 states that, by controlling the main phase of a hot-rolled steel sheet to be bainitic ferrite having an average grain diameter of 10 μm or less, it is possible to achieve a desired high strength after pipe making has been performed and to obtain a hot-rolled steel sheet having excellent low-temperature toughness. In addition, Japanese Unexamined Patent Application Publication No. 2012-172256 states that, by controlling the second phase to be a microstructure including 3.0% or more, in terms of area ratio, of martensite dispersed, it is possible to achieve a low yield ratio. Moreover, Japanese Unexamined Patent Application Publication No. 2012-172256 states that, by specifying the chemical composition and microstructure of a hot-rolled steel sheet as described above, it is possible to obtain a high-strength hot-rolled steel sheet with a low yield ratio excellent in terms of low-temperature toughness undergoing only a little decrease in strength after pipe making has been performed and having a yield strength in a direction at 30 degrees from the rolling direction of 480 MPa or more, a ductile-brittle transition temperature vTrs in a Charpy impact test of −80° C. or lower, and a low yield ratio of 85% or less.

However, in the conventional techniques described above, it is very difficult to obtain a hot-rolled steel sheet that can preferably be used as a material for an X80 grade linepipe. That is, it is very difficult to obtain a thick hot-rolled steel sheet having a high strength, excellent low-temperature toughness, a sufficient low-yield-ratio property which is effective against forced deformation caused by, for example, intense processing conditions when pipe making is performed or crustal movement after a pipeline has been constructed, and excellent stability of properties after processing has been performed (after pipe making has been performed).

In Japanese Unexamined Patent Application Publication No. 63-227715, there is a problem in that the hot-rolled steel sheet does not have strength as an X80 grade and in that there is a significant decrease in production efficiency because, for example, an air cooling process is included in a cooling process. In Japanese Unexamined Patent Application Publication No. 2006-299413, it is not possible to stably achieve a ductile-brittle transition temperature vTrs of −80° C. or lower, which is required for a cold-area-specification material having a good low-temperature toughness for which there is a growing demand nowadays. In addition, since steel having a comparatively good low-temperature toughness has a low strength, there may be a situation where the steel does not have strength as an X80 grade in, for example, a spiral steel pipe subjected to smaller forming strain than an electric resistance welded steel pipe.

In Japanese Unexamined Patent Application Publication No. 2012-172256, a decrease in strength after pipe making has been performed is suppressed by controlling a microstructure to be one including martensite and, optionally, bainite as a second phase. However, when only martensite or bainite is dispersed as a second phase, the degree of work hardening widely varies depending on the amount of forming strain when pipe making is performed. Therefore, for example, in an electric resistance welded steel pipe where there is usually a difference in the amount of forming strain between a position located at 90 degrees and a position located at 180 degrees (in the circumferential direction from the welded part which is assumed to be located at 0 degrees), there is a problem in that properties, in particular, a yield ratio varies with location in the circumferential direction of the pipe. When a yield ratio varies in the circumferential direction of the pipe as described above, there may be a problem in that the steel pipe undergoes buckling deformation because deformation is concentrated in a portion having a low yield ratio (low yield strength) when the steel pipe is deformed by being subjected to an external force caused by, for example, a crustal movement such as land subsidence or earthquake. Once a steel pipe undergoes buckling, since deformation is concentrated in the portion where buckling has occurred, the steel pipe tends to fracture because this portion further deforms.

It could therefore be helpful to provide a hot-rolled steel sheet which can preferably be used as a material for an X80 grade electric resistance welded steel pipe or a material for an X80 grade spiral steel pipe having a high strength, a high toughness, a low-yield-ratio property, and excellent stability of properties after pipe forming and to provide a method of manufacturing the steel sheet. Specifically, it could be helpful to provide a hot-rolled steel sheet having a tensile strength of 650 MPa or more, a yield strength of 555 MPa or more, a yield ratio of 90% or less, and a ductile-brittle transition temperature vTrs in a Charpy impact test of −80° C. or lower with which it is possible to control a variation in yield ratio ΔYR in the circumferential direction of the steel pipe (having a strain t/D×100 in the circumferential direction of the steel pipe of 1% or more and 9% or less, where D denotes the outer diameter of the steel pipe and t denotes the thickness of the hot-rolled steel sheet before pipe making is performed) of less than 10% after pipe making has been performed, and to provide a method of manufacturing the steel sheet.

SUMMARY

We provide:

[1] A hot-rolled steel sheet having a chemical composition containing, by mass %, C: 0.030% or more and 0.120% or less, Si: 0.05% or more and 0.50% or less, Mn: 1.00% or more and 2.20% or less, P: 0.025% or less, S: 0.0050% or less, N: 0.0060% or less, Al: 0.005% or more and 0.100% or less, Nb: 0.020% or more and 0.100% or less, Mo: 0.05% or more and 0.50% or less, Ti: 0.001% or more and 0.100% or less, Cr: 0.05% or more and 0.50% or less, Ca: 0.0005% or more and 0.0050% or less, and the balance being Fe and inevitable impurities, and having a microstructure including, bainitic ferrite as a main phase and martensite and retained austenite as second phases, in which the volume fraction of the main phase is 90% or more, the average grain diameter of the main phase is 10 μm or less, the volume fraction of the martensite is 0.5% or more and 9.5% or less, and the volume fraction of the retained austenite is 0.5% or more and 9.5% or less, in which a yield ratio of 90% or less, a yield strength of 555 MPa or more, and a tensile strength of 650 MPa or more.

[2] The hot-rolled steel sheet according to item [1] above, the steel sheet having the chemical composition further containing, by mass %, one or more selected from among V: 0.001% or more and 0.100% or less, Cu: 0.001% or more and 0.50% or less, Ni: 0.001% or more and 1.00% or less, and B: 0.0040% or less.

[3] A method of manufacturing a hot-rolled steel sheet, the method including: cooling a continuously cast slab having the chemical composition according to item [1] or [2] above to a temperature of 600° C. or lower; then heating the cooled slab in a temperature range of 1050° C. or higher and 1300° C. or lower; performing rough rolling; performing finish rolling following the rough rolling, in which rolling reduction in a non-recrystallization temperature range is 20% or more and 85% or less, and in which a finishing delivery temperature is equal to or higher than ($Ar_3$−50° C.) and equal to or lower than ($Ar_3$+100° C.); performing cooling following the finish rolling, in which an average cooling rate at the central position in the thickness direction of the steel sheet is 10° C./s or more and 100° C./s or less in a temperature range from the cooling start temperature to 650° C., and in which a cooling stop temperature is 420° C. or higher and 650° C. or lower; and performing coiling in a temperature range of 400° C. or higher and 650° C. or lower to obtain a coil having a weight of 20 tons or more and a width of 1000 mm or more.

It is possible to obtain a hot-rolled steel sheet having a high strength, a high toughness, and a low-yield-ratio property excellent in terms of stability of properties after processing has been performed which can preferably be used as a material for a steel pipe for use in, for example, pipelines, oil country tubular goods, and civil engineering and construction, in particular, for a steel pipe of grade X80 specified in the API Standards by using conventional hot rolling equipment, which has a marked effect on the industry.

DETAILED DESCRIPTION

As described in Japanese Unexamined Patent Application Publication No. 2012-172256, by controlling the main phase of a hot-rolled steel sheet to be bainitic ferrite having an average grain diameter of 10 μm or less, it is possible to achieve a desired high strength after pipe making has been performed and to obtain a hot-rolled steel sheet having excellent low-temperature toughness. However, in Japanese Unexamined Patent Application Publication No. 2012-172256 where the second phase of a hot-rolled steel sheet is controlled to be martensite or bainite and, in particular, in an electric resistance welded steel pipe where the amount of forming strain which is applied to a steel sheet during pipe manufacturing widely varies with location in the circumferential direction of the pipe, yield ratio widely varies with location in the circumferential direction of the steel pipe. To address this problem, we investigated a second phase with which a low-yield-ratio property is stably realized independently of the amount of forming strain applied after processing has been performed in a hot-rolled steel sheet having a microstructure including bainitic ferrite having an average grain diameter of 10 μm or less as a main phase.

First, we focused on utilization of retained austenite as a second phase with which it is possible to achieve a low yield ratio. Retained austenite, which is a soft microstructure, is an advantageous microstructure to control the yield ratio of steel to be low. In addition, when forming strain is applied to a hot-rolled steel sheet having a microstructure including retained austenite as a second phase, since retained austenite gradually transforms into strain-induced martensite starting from a lower C concentration portion, it is possible to keep the yield ratio low by increasing tensile strength while keeping yield strength comparatively low.

We then investigated the influence of the amount of retained austenite included in a hot-rolled steel sheet as a second phase on a low-yield-ratio property after processing has been performed and, as a result, found that when retained austenite is dispersed as a second phase in a hot-rolled steel sheet in an amount of 0.5% or more and 9.5% or less, in terms of volume fraction, it is possible to achieve a low yield ratio of 90% or less when forming strain in a range of 1% to 15% is applied. In addition, we found that as a result of retained austenite transforming into strain-induced martensite, there is an increase in the post-forming tensile strength of a hot-rolled steel sheet.

At the same time, however, we also found that when the second phase of a hot-rolled steel sheet is composed only of retained austenite, it is not possible to control the post-forming yield ratio of the hot-rolled steel sheet to be constant independently of the amount of forming strain. We then found that by containing retained austenite and martensite as the second phases in a hot-rolled steel sheet, it is possible to control the yield ratio to be almost constant independently of the amount of forming strain. In addition, we found that, by containing, in terms of volume fraction, 0.5% or more and 9.5% or less of retained austenite and 0.5% or more and 9.5% or less of martensite in combination as second phases, it is possible to stably achieve a low yield ratio in a low- to high-forming-strain range. Although there are many unclear points about the reason why it is possible to control the yield ratio to be almost constant independently of the amount of forming strain by containing retained austenite and martensite, it is believed to be because, by dispersing hard martensite in bainitic ferrite, the Bauschinger effect increases as a result of many movable dislocations generating in bainitic ferrite during pipe forming. The Bauschinger effect is a phenomenon in which, when a tensile test is performed after plastic deformation in the opposite direction (compressive direction) to the tensile direction has been applied, there is a decrease in yield strength compared to without deformation in the compressive direction. Since the inner surface of a steel pipe is subjected to compressive plastic deformation in the pipe forming process, the Bauschinger effect is expected to be realized. That is, it is believed that, since a decrease in yield strength due to the Bauschinger effect and an increase in yield strength due to the transformation induced plasticity of retained austenite balance each other, the yield ratio is almost constant independently of the amount of forming strain. In addition, we clarified that, by utilizing this knowledge, in particular, even in a steel pipe where the amount of forming strain is large, that is, a steel pipe having a large ratio (the thickness of a hot-rolled steel sheet before pipe manufacturing)/(the outer diameter of the steel pipe) or an electric resistance welded steel pipe, it is possible to stably achieve a low-yield-ratio property.

We further investigated a method of easily manufacturing without a decrease in production efficiency, a hot-rolled steel sheet having a desired microstructure described above (microstructure including 90% or more, in terms of volume fraction, of bainitic ferrite having an average grain diameter of 10 μm or less as a main phase and 0.5% or more and 9.5% or less, in terms of volume fraction, of retained austenite and 0.5% or more and 9.5% or less, in terms of volume fraction, of martensite as second phases) and, as a result, found that it is possible to manufacture a hot-rolled steel sheet having a desired microstructure with a high efficiency and ease without performing a special process such as air cooling in a cooling process before a coiling process following a hot rolling process by performing hot-rolling on a continuously cast slab having a specified chemical composition with, for example, specified slab heating conditions, finish rolling conditions, cooling rate in the central portion in the thickness direction of the steel sheet in a cooling process following finish rolling, and the weight and width of a coil.

Our steel sheets and methods will be specifically described hereafter.

First, the reasons for the limitations on the chemical composition of the hot-rolled steel sheet will be described. Hereinafter, % used below when describing a chemical composition always refers to mass %, unless otherwise noted.

C: 0.030% or More and 0.120% or Less

C is a chemical element important to achieve the strength (tensile strength and yield strength) of a hot-rolled steel sheet by forming carbides with Nb, V, and Ti and is indispensable to form second phases (retained austenite and martensite) important to control the yield ratio of a hot-rolled steel sheet to be low. It is necessary that the C content be 0.030% or more to achieve a desired strength and low yield ratio in the hot-rolled steel sheet. On the other hand, when the C content is more than 0.120%, there is a decrease in the toughness of the hot-rolled steel sheet due to an excessive increase in the amount of carbides. Also, when the C content is more than 0.120%, since a carbon equivalent is high, there is a decrease in the toughness of a welded part when such a hot-rolled steel sheet is subjected to pipe making and welding. Therefore, the C content is 0.030% or more and 0.120% or less, or preferably 0.040% or more and 0.090% or less.

Si: 0.05% or More and 0.50% or Less

When there is an increase in the Si content, Mn-Si-based non-metal inclusions are formed, which results in a decrease in the toughness of a welded part when such a hot-rolled steel sheet is subjected to pipe making and welding. Therefore, the upper limit of the Si content is 0.50%. On the other hand, the lower limit of the Si content is 0.05% to achieve the strength of grade X80 through solid solution strengthening. It is preferable that the Si content be 0.10% or more and 0.35% or less.

Mn: 1.00% or More and 2.20% or Less

Mn is a chemical element necessary to achieve the strength and toughness of a hot-rolled steel sheet by inhibiting formation of polygonal ferrite. Also, Mn is a chemical element necessary to achieve the low-yield-ratio property of a hot-rolled steel sheet by promoting formation of second phases and stably forming retained austenite and martensite. It is necessary that the Mn content be 1.00% or more to realize such effects. On the other hand, when the Mn content is more than 2.20%, there is a tendency for a variation in the mechanical properties of a hot-rolled steel sheet to occur due to center segregation and there is a decrease in toughness. Also, when the Mn content is more than 2.20%, there may be a negative effect such as a decrease in elongation capability due to an increase in the strength of a hot-rolled steel sheet, and there may be a decrease in the toughness of a welded part due to an increase in carbon equivalent. Therefore, the Mn content is 1.00% or more and 2.20% or less, or preferably 1.40% or more and 2.00% or less.

P: 0.025% or Less, S: 0.0050% or Less, and N: 0.0060% or Less

Since P, which is present in steel as an impurity, is a chemical element tending to be segregated, P causes a decrease in the toughness of a hot-rolled steel sheet. Therefore, the upper limit of the P content is 0.025%, or preferably 0.018%.

Since S and N, like P, decrease the toughness of a hot-rolled steel sheet, the upper limit of the S content is 0.0050%, and the upper limit of the N content is 0.0060%. It is preferable that the S content be 0.0030% or less and that the N content be 0.0040% or less.

The lower limits of the contents of P, S, and N are all decided in consideration of the practical limit of the control capability of a steel making process. It is preferable that the lower limits of each of the P content and the N content be 0.0010% and that the lower limit of the S content be 0.0001%.

Al: 0.005% or More and 0.100% or Less

Al is effective as a deoxidizing agent for steel, and the Al content is 0.005% or more with which the effect of deoxidizing is realized. However, when the Al content is excessively large, alumina-based inclusions are formed, which results in defects occurring in a welded part when a hot-rolled steel sheet is subjected to welding. Therefore, the Al content is 0.005% or more and 0.100% or less, or preferably 0.010% or more and 0.050% or less.

Nb: 0.020% or More and 0.100% or Less

Nb is effective to decrease grain diameter, is a precipitation strengthening chemical element, and it is necessary that the Nb content be 0.020% or more to achieve a steel pipe strength of grade X80. On the other hand, when the Nb content is excessively large, there is a decrease in toughness due to excessive precipitation in the coiling temperature range described below (400° C. or higher and 650° C. or lower) when a hot-rolled steel sheet is manufactured, and there is a decrease in weldability. Therefore, the Nb content is 0.020% or more and 0.100% or less, or preferably 0.030% or more and 0.080% or less.

Mo: 0.05% or More and 0.50% or Less

Mo is a chemical element effective to increase the strength of a hot-rolled steel sheet by inhibiting austenite in a steel sheet from transforming into polygonal ferrite or pearlite in a cooling process following a hot rolling process when a hot-rolled steel sheet is manufactured. In addition, Mo is a chemical element necessary to achieve a satisfactory low-yield-ratio property of a hot-rolled steel sheet by promoting formation of second phases (retained austenite and martensite). The Mo content is 0.05% or more to realize such effects. However, since Mo has a strong hardenability, when the Mo content is more than 0.50%, there is a decrease in the toughness of a hot-rolled steel sheet due to formation of excessive amounts of retained austenite and martensite, which are second phases. Therefore, the Mo content is 0.05% or more and 0.50% or less, or preferably 0.10% or more and 0.35% or less.

Ti: 0.001% or More and 0.100% or Less

Ti is a chemical element effective to decrease grain diameter and is a precipitation strengthening chemical element. It is necessary that the Ti content be 0.001% or more to realize such effects. On the other hand, when the Ti content is excessively large, there is a decrease in the weldability of a hot-rolled steel sheet. Therefore, the Ti content is 0.001% or more and 0.100% or less, or preferably 0.010% or more and 0.040% or less.

Cr: 0.05% or More and 0.50% or Less

Cr is a chemical element effective to delay pearlite transformation in a cooling process following a hot rolling process when a hot-rolled steel sheet is manufactured and which is effective to decrease the amount of intergranular cementite. In addition, Cr is a chemical element necessary to achieve the low-yield-ratio property of a hot-rolled steel sheet by promoting formation of retained austenite and martensite, which are second phases. The Cr content is 0.05% or more to realize such effects. On the other hand, when the Cr content is more than 0.50%, there is a decrease in the toughness of a hot-rolled steel sheet due to formation of excessive amounts of retained austenite and martensite, which are second phases. In addition, when the Cr content is excessively large, there is a decrease in the toughness of a welded part due to formation of a hardened structure in a welded part when a hot-rolled steel sheet is subjected to pipe making and welding. Therefore, the Cr content is 0.05% or more and 0.50% or less, or preferably 0.10% or more and 0.35% or less.

Ca: 0.0005% or More and 0.0050% or Less

Ca is effective in increasing the toughness of a hot-rolled steel sheet by inhibiting formation of MnS as a result of fixing S. The Ca content is 0.0005% or more to realize such an effect. On the other hand, since there is a decrease in the toughness of a hot-rolled steel sheet due to formation of Ca-based oxides when the Ca content is excessively large, the Ca content is 0.0050% or less. It is preferable that the Ca content be 0.0010% or more and 0.0030% or less.

Although the chemical composition described above is the basic chemical composition of a hot-rolled steel sheet, one, two, or more selected from among V: 0.001% or more and 0.100% or less, Cu: 0.001% or more and 0.50% or less, Ni: 0.001% or more and 1.00% or less, and B: 0.0040% or less may be added in addition to the basic chemical composition described above.

V: 0.001% or More and 0.100% or Less

V is a precipitation strengthening chemical element, and it is preferable that the V content be 0.001% or more to realize such an effect. On the other hand, when the V content is excessively large, since an excessive amount of precipitates is formed in the coiling temperature range (400° C. or higher and 650° C. or lower) described below when a hot-rolled steel sheet is manufactured, there may be a decrease in toughness and elongation property, and there may be a decrease in weldability. Therefore, it is preferable that the V content be 0.001% or more and 0.100% or less, or more preferably 0.020% or more and 0.080% or less.

Cu: 0.001% or More and 0.50% or LESS

Cu is a chemical element effective to inhibit austenite in a steel sheet from transforming into polygonal ferrite or pearlite in a cooling process following a hot rolling process when a hot-rolled steel sheet is manufactured and which is effective to increase the strength of a hot-rolled steel sheet. It is preferable that the Cu content be 0.001% or more to realize such effects. However, when the Cu content is more than 0.50%, there may be a decrease in the hot workability of steel. Therefore, it is preferable that the Cu content be 0.001% or more and 0.50% or less, or more preferably 0.10% or more and 0.40% or less.

Ni: 0.001% or More and 1.00% or Less

Ni is a chemical element effective to inhibit austenite in a steel sheet from transforming into polygonal ferrite or pearlite in a cooling process following a hot rolling process when a hot-rolled steel sheet is manufactured and which is effective to increase the strength of a hot-rolled steel sheet. It is preferable that the Ni content be 0.001% or more to realize such effects. However, when the Ni content is more than 1.00%, there may be a decrease in the hot workability of steel. Therefore, it is preferable that the Ni content be 0.001% or more and 1.00% or less, or more preferably 0.10% or more and 0.50% or less.

B: 0.0040% or Less

B is effective to prevent formation of polygonal ferrite by inhibiting ferrite transformation at a high temperature in a cooling process following finish rolling when a hot-rolled steel sheet is manufactured. It is preferable that the B content be 0.0001% or more to realize such an effect. On the other hand, when the B content is excessively large, a hardened structure may be formed in a welded part when a hot-rolled steel sheet is subjected to welding. Therefore, it is preferable that the B content be 0.0040% or less, or more preferably 0.0002% or more and 0.0010% or less.

In the hot-rolled steel sheet, constituent chemical elements other than those described above are Fe and inevitable impurities. Examples of the inevitable impurities include Co, W, Pb, and Sn, and it is preferable that the content of each of these chemical elements be 0.02% or less.

Hereafter, the reasons for the limitations on the microstructure of the hot-rolled steel sheet will be described.

The hot-rolled steel sheet has a microstructure including bainitic ferrite as a main phase and martensite and retained austenite as second phases in which the volume fraction of the main phase is 90% or more, in which the average grain diameter of the main phase is 10 μm or less, in which the volume fraction of the martensite is 0.5% or more and 9.5% or less, and in which the volume fraction of the retained austenite is 0.5% or more and 9.5% or less. Bainitic ferrite is a microstructure including a substructure having a high dislocation density in which cementite is not precipitated in grains. In contrast, bainite is different from bainitic ferrite in that bainite includes a lath structure having a high dislocation density in which cementite is precipitated in the grains. In addition, polygonal ferrite is different from bainitic ferrite in that polygonal ferrite has a very low dislocation density.

Volume Fraction of Bainitic Ferrite: 90% or More

Average Grain Diameter of Bainitic Ferrite: 10 μm or Less

By controlling the main phase of a hot-rolled steel sheet to be a fine bainitic ferrite excellent in terms of strength-toughness balance, the hot-rolled steel sheet is provided with a desired strength and low-temperature toughness. By controlling the volume fraction of bainitic ferrite, which is a main phase, to be 90% or more, and by controlling the average grain diameter of the bainitic ferrite to be 10 μm or less, it is possible to achieve satisfactory strength and low-temperature toughness of a hot-rolled steel sheet through the effect of a decrease in grain diameter. On the other hand, when the volume fraction of bainitic ferrite is less than 90%, since there is an increase in the number of crack propagation paths due to an increase in the volume fraction of second phases, there is a decrease in the low-temperature toughness of a hot-rolled steel sheet. In addition, when the average grain diameter of bainitic ferrite is more than 10 μm, there is a decrease in toughness due to an increase in fracture facet size.

To achieve satisfactory strength and low-temperature toughness of a hot-rolled steel sheet, it is preferable that the volume fraction of bainitic ferrite be 91% or more, and it is preferable that the average grain diameter of bainitic ferrite be 3.0 μm or less. In particular, since martensite and retained austenite, which decrease toughness, are included, it is preferable that the average grain diameter of bainitic ferrite be 3.0 μm or less when the total volume fraction of martensite and retained austenite is 4.0% or more. However, since there is a significant decrease in the volume fraction of second phases (retained austenite and martensite), which are important to decrease the yield ratio of a hot-rolled steel sheet, when the volume fraction of bainitic ferrite is excessively large, it is preferable that the volume fraction of bainitic ferrite be 95% or less. In addition, although it is preferable that the grain diameter of bainitic ferrite be as small as possible, the lower limit of the average grain diameter thereof is substantially about 1 μm.

Volume Fraction of Retained Austenite: 0.5% or More and 9.5% or Less

Since retained austenite undergoes strain-induced transformation due to forming strain, for example, when pipe making is performed, in a sequence starting from a portion having a lower C concentration, there is an increase in work hardenability in a wide forming-strain range (for example, a forming-strain range of 1% to about 10%) corresponding to strain applied in a pipe making process. Therefore, since it is possible to increase tensile strength compared to yield strength, it is possible to achieve a low yield ratio. As a result, for example, even in an electric resistance welded steel pipe where forming strain due to pipe making varies in the circumferential direction of the pipe, it is possible to stably achieve a low-yield-ratio property independently of location in the circumferential direction. It is necessary that the volume fraction of retained austenite be 0.5% or more, or preferably 2.0% or more to realize such an effect. On the other hand, when the volume fraction of retained austenite is more than 9.5%, since retained austenite functions as a crack propagation path, there is a decrease in the low-temperature toughness of a hot-rolled steel sheet. Therefore, it is necessary that the volume fraction of retained austenite be 9.5% or less. It is preferable that the volume fraction of retained austenite be 5% or less to achieve further increased low-temperature toughness.

Volume Fraction of Martensite: 0.5% or More and 9.5% or Less

Martensite increases the Bauschinger effect by facilitating the formation of movable dislocations during processing into bainitic ferrite. It is necessary that the volume fraction of martensite be 0.5% or more, or preferably 2.5% or more to realize such an effect. On the other hand, when the volume fraction of martensite is more than 9.5%, since martensite functions as a crack propagation path, there is a decrease in the low-temperature toughness of a hot-rolled steel sheet. Therefore, it is necessary that the volume fraction of martensite be 9.5% or less. It is preferable that the volume fraction of martensite be 5% or less to achieve further increased low-temperature toughness.

The microstructure of the hot-rolled steel sheet may include pearlite and cementite in addition to bainitic ferrite, retained austenite, and martensite described above. It is preferable that the volume fraction of the microstructures other than bainitic ferrite, retained austenite, and martensite, that is, pearlite and cementite be limited to 2% or less in total. In addition, it is preferable that the thickness of the hot-rolled steel sheet to be used as a material mainly for a linepipe be 15 mm or more and 30 mm or less.

Hereafter, the method of manufacturing the hot-rolled steel sheet will be described.

It is possible to manufacture the hot-rolled steel sheet by cooling a slab (cast piece) having the chemical composition described above which has been obtained by using a continuous casting method to a specified temperature or less, heating the cooled slab, performing rough rolling and finish rolling on the heated slab, performing accelerated cooling on the rolled steel sheet under specified conditions, and coiling the cooled steel sheet at a specified temperature to obtain a coil having a specified weight and width.

Cooling temperature of a continuously cast slab: 600° C. or lower

A continuously cast slab which has not undergone ferrite transformation has an austenite structure and has a very large grain diameter because it has been exposed to a high temperature for a long time. Therefore, such a large austenite grain diameter is decreased through ferrite transformation. Therefore, the continuously cast slab is cooled to a temperature of 600° C. or lower, or preferably 500° C. or lower, at which ferrite transformation is almost completed. Subsequently, the continuously cast slab is heated to undergo reverse transformation into austenite, which results in a further decrease in grain diameter.

Heating temperature of a continuously cast slab: 1050° C. or higher and 1300° C. or lower When the slab heating temperature (reheating temperature of a continuously cast slab) is lower than 1050° C., since Nb, V, and Ti, which are precipitation strengthening chemical elements, do not sufficiently form a solid solution, it is not possible to achieve steel pipe strength of grade X80. On the other hand, when the heating temperature is higher than 1300° C., since there is an increase in austenite grain diameter and since, as a result, there is an increase in bainitic ferrite grain diameter, there is a decrease in the low-temperature toughness of a hot-rolled steel sheet, and there is a decrease in the toughness and elongation property of a hot-rolled steel sheet because an excessive amount of Nb is precipitated in cooling and coiling processes following a finish rolling process. Therefore, the reheating temperature of a continuously cast slab is 1050° C. or higher and 1300° C. or lower, or preferably 1150° C. or higher and 1230° C. or lower.

The heated slab (continuously cast piece) is subjected to rough rolling and finish rolling to have an arbitrary thickness, and there is no particular limitation on what condition is used for rough rolling.

Rolling reduction in the non-recrystallization temperature range when finish rolling is performed: 20% or more and 85% or less By performing finish rolling in the non-recrystallization temperature range (about 930° C. or lower in the steel chemical composition), since strain is accumulated due to the delay of the recrystallization of austenite, there is a decrease in ferrite (bainitic ferrite) grain diameter when $\gamma/\alpha$ transformation occurs, which results in an increase in the strength and toughness of a hot-rolled steel sheet. When the rolling reduction in the non-recrystallization temperature range when finish rolling is performed is less than 20%, such an effect is not sufficiently realized. On the other hand, when the rolling reduction described above is more than 85%, there is a problem in rolling due to an increase in resistance to deformation. Therefore, the rolling reduction described above is 20% or more and 85% or less, or preferably 35% or more and 75% or less.

Finishing delivery temperature: equal to or higher than ($Ar_3$−50° C.) and equal to or lower than ($Ar_3$+100° C.)

It is necessary that the finishing delivery temperature be equal to or higher than ($Ar_3$−50° C.) to finish rolling with a uniform grain diameter and microstructure being obtained. When the finishing delivery temperature is lower than ($Ar_3$−50° C.), since ferrite transformation occurs inside a hot-rolled steel sheet during a finish rolling process, polygonal ferrite is partially formed. Polygonal ferrite has a larger grain diameter than that of bainitic ferrite which is formed during a subsequent cooling process or after the cooling has been performed, which results in formation of a mixed grain structure having a variation in grain diameter. Therefore, it is not possible to achieve the desired properties of a hot rolled steel sheet. On the other hand, the finishing delivery temperature is higher than ($Ar_3$+100° C.), since there is an increase in bainitic ferrite grain diameter, there is a decrease in the toughness of a hot-rolled steel sheet. In particular, since martensite and retained austenite, which have a negative effect on toughness, are included in addition to bainitic ferrite, it is necessary to decrease a bainitic ferrite grain diameter to achieve satisfactory toughness. Therefore, the finishing delivery temperature is equal to or higher than ($Ar_3$−50° C.) and equal to or lower than ($Ar_3$+100° C.), or preferably equal to or higher than ($Ar_3$−20° C.) and equal to or lower than ($Ar_3$+50° C.).

The "finishing delivery temperature" refers to the surface temperature of a steel sheet determined at the exit of a finish rolling mill.

After finish rolling has been performed, accelerated cooling is performed under the following conditions. It is preferable that accelerated cooling be started within 7 seconds, or more preferably within 3 seconds, after finish rolling has been performed. When the time until accelerated cooling is started after finish rolling has been performed is more than 7 seconds, there may be an increase in grain diameter, or ferrite transformation may start so that polygonal ferrite is formed.

Average cooling rate at the central position in the thickness direction of the steel sheet in a temperature range from the cooling start temperature to 650° C.: 10° C./s or more and 100° C./s or less It is necessary that an average cooling rate at the central position in the thickness direction of the steel sheet in a temperature range from the cooling start temperature to 650°

C. be 10° C./s or more to achieve satisfactory low-temperature toughness of a hot-rolled steel sheet by controlling the volume fraction of bainitic ferrite to be 90% or more as a result of inhibiting pearlite transformation and the formation of polygonal ferrite. However, when the cooling rate at the central position in the thickness direction of the steel sheet in the temperature range described above is excessively high, since there is an increase in the surface hardness of the steel sheet, the steel sheet is unsuitable for a steel sheet for a linepipe. Therefore, it is necessary that the upper limit of the average cooling rate described above be 100° C./s. It is preferable that the average cooling rate is 25° C./s or more and 50° C./s or less.

Cooling stop temperature at the central position in the thickness direction of the steel sheet: 420° C. or higher and 650° C. or lower It is necessary to retain untransformed austenite by leaving the transformation of austenite in a steel sheet (austenite-to-bainitic ferrite transformation) unfinished in the cooling process to disperse retained austenite and martensite in a microstructure as second phases. Therefore, it is necessary that the temperature at which accelerated cooling is stopped is 420° C. or higher in terms of the temperature at the central position in the thickness direction of the steel sheet. On the other hand, when the temperature at which accelerated cooling is stopped is higher than 650° C., since polygonal ferrite and pearlite having a large grain diameter are formed, it is not possible to achieve a desired microstructure of a hot-rolled steel sheet. Therefore, it is necessary that the cooling stop temperature of accelerated cooling is 420° C. or higher and 650° C. or lower, or preferably 500° C. or higher and 590° C. or lower, in terms of the temperature at the central position in the thickness direction of the steel sheet.

Coiling temperature: 400° C. or higher and 650° C. or lower

Austenite and martensite, which are second phases, are formed in an air cooling process following a coiling process. Therefore, it is necessary that C be diffused from bainitic ferrite, which is formed through transformation in the accelerated cooling process or after cooling has been stopped, to untransformed austenite. When C is diffused from bainitic ferrite to untransformed austenite, since C is concentrated in the untransformed austenite, the untransformed austenite is inhibited from transforming into bainite, which results in martensite or retained austenite (untransformed austenite cooled to room temperature with the microstructure being unchanged) being obtained from the untransformed austenite. Whether martensite or retained austenite is obtained depends on the degree of the C concentration, and retained austenite is obtained in a portion in which there is an increase in C concentration so that the Ms point (temperature at which martensite transformation starts) is lower than room temperature.

It is necessary that the coiling temperature be 400° C. or higher to form a microstructure including a desired volume fractions of retained austenite and martensite by diffusing a sufficient amount of C in an air cooling process following a coiling process. On the other hand, when the coiling temperature is higher than 650° C., since polygonal ferrite and pearlite having a large grain diameter are formed, it is not possible to achieve a desired microstructure of a hot-rolled steel sheet. Therefore, it is necessary that the coiling temperature is 400° C. or higher and 650° C. or lower, or preferably 480° C. or higher and 580° C. or lower. The "coiling temperature" described above refers to the temperature at the central position in the thickness direction of the steel sheet in any case.

Coil Weight After Coiling has Been Performed: 20 Tons or More

Coil Width After Coiling has Been Performed: 1000 mm or More

It is necessary to disperse both retained austenite and martensite as second phase structures in a hot-rolled steel sheet by transforming a part of austenite retained in the untransformed state into martensite in an air cooling process following a coiling process. To disperse a desired volume fraction of retained austenite and martensite as second phases, a cooling rate after coiling has been performed is very important.

To form a microstructure including a desired volume fraction of retained austenite and martensite, it is preferable to promote the diffusion of C from bainitic ferrite to untransformed austenite by decreasing a cooling rate as much as possible after coiling has been performed. However, when the cooling rate is controlled by performing, for example, furnace cooling, it is necessary to newly install, for example, a cooling furnace to the rolling equipment, there is a disadvantage from the viewpoint of equipment costs. Therefore, by specifying coil weight and coil width after coiling has been performed, an air cooling rate is decreased after coiling has been performed.

It is necessary that the coil weight be 20 tons or more and the coil width be 1000 mm or more to sufficiently decrease the air cooling rate after coiling has been performed by decreasing the ratio of (surface area)/(volume) of a coil. When the coil weight after coiling has been performed is less than 20 tons or the coil width after coiling has been performed is less than 1000 mm, since the amount of C concentrated is not sufficient for austenite retained in the untransformed state to be stable due to excessive large air cooling rate after coiling has been performed, only martensite is preferentially formed as a second phase. As a result, since there is an insufficient amount of retained austenite in a hot-rolled steel sheet, it is not possible to achieve stable low-yield-ratio property in a wide forming-strain range. It is preferable that the air cooling rate after coiling has been performed is 70° C./s or less, or more preferably 50° C./s or less to achieve the amount of retained austenite. The "air cooling rate after coiling has been performed" refers to an average cooling rate of 400° C. to 390° C. in terms of the temperature of a steel sheet. The temperature of a coil is determined at the central position in the width direction of the peripheral surface of the coil after coiling has been performed. The temperature of a coil is determined by using a thermocouple attached to a proper portion of the steel sheet where the steel sheet is coiled tightly such that no air gap is formed therein, the portion being positioned at the center in the width direction of the peripheral surface of the steel sheet. In addition, the reason to define an air cooling rate after coiling has been performed as an average cooling rate of 400° C. to 390° C. is because C is most likely to be concentrated in austenite retained in the untransformed state in a temperature range around 400° C.

For the reasons described above, the coil weight after coiling has been performed is 20 tons or more and the coil width after coiling has been performed is 1000 mm or more. In addition, it is preferable that the coil weight after coiling has been performed is 25 tons or more and the coil width after coiling has been performed is 1400 mm or more. Although there is no particular limitation on the upper limits of the coil weight and the coil width after coiling has been performed, considering the operation records of the rolling equipment, the substantial upper limits of the coil weight and coil width are respectively about 40 tons and about 2500 mm.

EXAMPLES

By casting slabs (continuously cast piece having a thickness of 215 mm) having the chemical compositions given in Table 1, by cooling the cast slabs to a temperature of about 400° C. or lower, further performing hot rolling under the hot rolling conditions given in Table 2, cooling the hot-rolled steel sheet under the cooling conditions given in Table 2 following the hot rolling, and coiling the cooled steel sheet into coils having the specified sizes at a coiling temperatures given in Table 2, hot-rolled steel sheets (steel strips) having the thicknesses given in Table 2 were obtained. The cooling described above (accelerated cooling) was started within 3 seconds after finish rolling had been performed. In addition, the $Ar_a$ points given in Table 2 were determined from thermal expansion curves obtained by taking samples for thermal expansion determination from the obtained slabs, by transforming them into austenite at a temperature of 950° C., and then cooling the samples at a cooling rate of 5° C./min.

By forming the obtained hot-rolled steel sheets (steel strips) by performing cage-roll forming, performing electric resistance welding, grinding the inner beads, then performing a heat treatment only on the welded parts by using a post-annealing device, and performing sizing, electric resistance welded steel pipes having an outer diameter of 16 inches were obtained.

In the examples, although a manufacturing method in which an electric resistance welded steel pipe is manufactured from a hot-rolled steel sheet was used, it is possible to use the hot-rolled steel sheet not only for an electric resistance welded steel pipe but also for various kinds of steel pipes such as a spiral steel pipe.

By taking test pieces from the obtained hot-rolled steel sheets and the electric resistance welded steel pipes, microstructure observation, a tensile test, and a Charpy impact test were performed. The methods for microstructure observation and the various tests were as follows.

(1) Microstructure Observation

By observing the microstructures in the three or more fields of view each at the central position in the thickness direction of the obtained hot-rolled steel sheet, at a position of ¼ of the thickness, at a position of ¾ of the thickness, and at a position located at 1 mm from the surface of the steel sheet by using a scanning electron microscope (at a magnification of 2000 times) to obtain the photographs of the observed images, the volume fractions of bainitic ferrite, retained austenite, martensite, and pearlite were determined. From the results of the microstructure observation of the obtained hot-rolled steel sheets, no microstructure other than bainitic ferrite, retained austenite, martensite, and pearlite was observed in the matrix in the hot-rolled steel sheet of our examples.

By performing image analysis on the photographs obtained as described above to separate bainitic ferrite from the microstructures other than bainitic ferrite, by determining the area ratio of bainitic ferrite in each field of view, the volume fraction of bainitic ferrite was defined as the average value of the area ratios determined at all of the positions in the thickness direction described above. In addition, by determining the area ratio of pearlite in each field of view by using the same method, the volume fraction of pearlite was defined as the average value of the area ratios determined at all of the positions in the thickness direction described above. Moreover, by using the same method, the volume fraction of polygonal ferrite was determined. The average grain diameter of bainitic ferrite was defined as the circle-equivalent diameter obtained by performing image analysis on the microstructures which were recognized as bainitic ferrite.

There is no distinct contrast between retained austenite and martensite under a scanning electron microscope. Therefore, first, by determining the total area ratio of retained austenite and martensite in each field of view by using the same method described above, the total volume fraction of retained austenite and martensite was defined as the average value of the area ratios determined at all of the positions in the thickness direction described above. Subsequently, by determining the volume fraction of retained austenite by using an X-ray diffraction method, the volume fraction of martensite was defined as the result of subtracting the volume fraction of retained austenite from the total volume fraction described above.

The volume fraction of retained austenite was determined by using the X-ray diffraction method described below.

By taking an X-ray diffraction test piece in a direction parallel to the surface of the steel sheet, by performing grinding and chemical polishing on the test piece, a surface at a position of ¼ of the thickness of the steel sheet was exposed as the surface of the polished test piece. Subsequently, by determining the diffraction intensities of the (200) plane and (211) plane of $\alpha$ and the (200) plane, (220) plane, and (311) plane of $\gamma$ by the X-ray diffraction analysis for the test pieces, the volume fraction of y was calculated.

(2) Tensile Test

By taking a full-thickness flat tensile test piece (having a thickness equal to the full-thickness of the steel sheet, a length of the parallel portion of 60 mm, a gauge length of 50 mm, and a gauge width of 38 mm) from the central position in the width direction of the obtained hot-rolled steel sheet so that the longitudinal direction of the test piece was a direction (C-direction) at a right angle to the rolling direction, and performing a tensile test at room temperature in accordance with the prescription in ASTM E8M-04 to determine tensile strength TS and yield strength YS, a yield ratio YR (=YS/TS) was derived. In addition, after having flattening the obtained electric resistance welded steel pipe, tensile test pieces having the same shape as described above were taken from the position located at 90 degrees and the position located at 180 degrees in the circumferential direction from the welded part which was assumed to be located at 0 degrees so that the longitudinal direction of the test pieces was the circumferential direction of the steel pipe. Subsequently, by deriving yield ratios by performing a tensile test under the same conditions described above, the difference in yield ratio $\Delta$YR between the position located at 90 degrees and the position located at 180 degrees are different in forming strain from each other. When the tensile strength TS, yield strength YS, and yield ratio YR of a hot-rolled steel sheet were respectively 650 MPa or more, 555 MPa or more, and 90% or less and where the difference $\Delta$YR in yield ratio between the position at 90 degrees and the position at 180 degrees of an electric resistance welded steel pipe was less than 10% it was judged as "tensile properties excellent in terms of strength, stability of properties after processing has been performed, and low-yield-ratio property".

(3) Charpy Impact Test

By taking a V-notch test piece (having a length of 55 mm, a height of 10 mm, and a width of 10 mm) from the central position in the thickness direction of the obtained hot-rolled steel sheet so that the longitudinal direction of the test piece was a direction (C-direction) at a right angle to the rolling direction, and by performing a Charpy impact test in accordance with the prescription in JIS Z 2242, a ductile-brittle transition temperature (° C.) was determined. Three test pieces were taken from each of the hot-rolled steel sheets, and the ductile-brittle transition temperature (vTrs) of each of the hot-rolled steel sheets was defined as the arithmetic average value of the obtained ductile-brittle transition temperatures of the three test pieces. A vTrs of −80° C. or lower was judged as "good toughness".

TABLE 1

| Steel | Chemical Composition (mass %) | | | | | | | |
|---|---|---|---|---|---|---|---|---|
| No. | C | Si | Mn | P | S | Al | N | Nb |
| 1 | 0.066 | 0.22 | 1.74 | 0.016 | 0.0022 | 0.030 | 0.0026 | 0.055 |
| 2 | 0.080 | 0.25 | 1.89 | 0.011 | 0.0025 | 0.031 | 0.0030 | 0.079 |
| 3 | 0.039 | 0.29 | 1.91 | 0.015 | 0.0022 | 0.031 | 0.0022 | 0.042 |
| 4 | 0.034 | 0.19 | 1.55 | 0.016 | 0.0025 | 0.026 | 0.0034 | 0.031 |
| 5 | 0.051 | 0.23 | 2.05 | 0.012 | 0.0025 | 0.030 | 0.0020 | 0.055 |
| 6 | 0.069 | 0.24 | 1.99 | 0.017 | 0.0018 | 0.029 | 0.0025 | 0.049 |
| 7 | 0.085 | 0.16 | 1.57 | 0.012 | 0.0022 | 0.033 | 0.0032 | 0.067 |
| 8 | 0.051 | 0.30 | 1.62 | 0.020 | 0.0018 | 0.031 | 0.0031 | 0.039 |
| 9 | 0.035 | 0.22 | 1.46 | 0.018 | 0.0025 | 0.028 | 0.0022 | 0.052 |
| 10 | 0.046 | 0.33 | 1.67 | 0.016 | 0.0018 | 0.027 | 0.0023 | 0.060 |

| Steel | Chemical Composition (mass %) | | | | | |
|---|---|---|---|---|---|---|
| No. | Mo | Ti | Cr | Ca | Other | Note |
| 1 | 0.25 | 0.014 | 0.14 | 0.0020 | — | Example Steel |
| 2 | 0.29 | 0.019 | 0.29 | 0.0023 | — | Example Steel |
| 3 | 0.13 | 0.035 | 0.09 | 0.0024 | — | Example Steel |
| 4 | 0.31 | 0.022 | 0.11 | 0.0018 | V: 0.061 | Example Steel |
| 5 | 0.09 | 0.013 | 0.26 | 0.0018 | Cu: 0.35, Ni: 0.34 | Example Steel |
| 6 | 0.17 | 0.011 | 0.17 | 0.0016 | B: 0.0009 | Example Steel |
| 7 | 0.03 | 0.020 | 0.16 | 0.0015 | B: 0.0002 | Comparative Steel |
| 8 | 0.11 | 0.029 | 0.03 | 0.0015 | Cu: 0.11, Ni: 0.11 | Comparative Steel |
| 9 | 0.55 | 0.019 | 0.10 | 0.0020 | — | Comparative Steel |
| 10 | 0.12 | 0.015 | 0.56 | 0.0024 | — | Comparative Steel |

TABLE 2

| | | | | Finish Rolling Condition | | | | | | | Coil Size after Coiling | | | |
|---|---|---|---|---|---|---|---|---|---|---|---|---|---|---|
| Steel Sheet No. | Steel No. | $Ar_3$ Point (° C.) | Slab Reheating Temperature (° C.) | Finishing Delivery Temperature (° C.) | Rolling Reduction in Non-recrystallization Range (%) | Cooling Start Temperature *1 (° C.) | Average Cooling Rate*2 (° C./s) | Cooling Stop Temperature *3 (° C.) | Coiling Temperature *4 (° C.) | Air cooling Rate after Coiling*5 (° C./s) | Coil Weight (ton) | Coil width (mm) | Thickness (mm) | Note |
| 1A | 1 | 729 | 1200 | 761 | 60 | 770 | 36 | 539 | 525 | 48 | 29 | 2100 | 25 | Example |
| 1B | | 729 | 1200 | 775 | 60 | 790 | 33 | 516 | 505 | 74 | 13 | 1350 | 16 | Comparative Example |
| 2A | 2 | 714 | 1210 | 759 | 60 | 770 | 27 | 502 | 490 | 66 | 28 | 2440 | 17 | Example |
| 2B | | 714 | 1210 | 774 | 60 | 780 | 28 | 672 | 660 | 44 | 32 | 1900 | 29 | Comparative Example |
| 3A | 3 | 730 | 1200 | 716 | 60 | 730 | 26 | 510 | 500 | 50 | 32 | 1470 | 20 | Example |
| 3B | | 730 | 1200 | 775 | 60 | 780 | 35 | 572 | 560 | 82 | 34 | 900 | 20 | Comparative Example |
| 4A | 4 | 754 | 1190 | 736 | 60 | 750 | 33 | 540 | 520 | 44 | 24 | 1610 | 23 | Example |
| 5A | 5 | 714 | 1220 | 763 | 60 | 780 | 29 | 586 | 570 | 50 | 31 | 1460 | 15 | Example |
| 6A | 6 | 711 | 1150 | 720 | 60 | 740 | 17 | 432 | 420 | 45 | 23 | 1870 | 19 | Example |
| 7A | 7 | 732 | 1230 | 752 | 60 | 760 | 16 | 538 | 520 | 46 | 31 | 1830 | 21 | Comparative Example |
| 8A | 8 | 745 | 1260 | 767 | 60 | 770 | 16 | 618 | 600 | 45 | 35 | 1540 | 21 | Comparative Example |

TABLE 2-continued

| Steel Sheet No. | Steel No. | $Ar_3$ Point (° C.) | Finish Rolling Condition: Slab Re-heating Tem-per-ature (° C.) | Finish Rolling Condition: Finishing Delivery Tem-per-ature (° C.) | Finish Rolling Condition: Rolling Reduction in Non-recrystal-lization Range (%) | Cooling Start Tem-per-ature *1 (° C.) | Average Cooling Rate*2 (° C./s) | Cooling Stop Tem-per-ature *3 (° C.) | Coiling Tem-per-ature *4 (° C.) | Air cooling Rate after Coiling*5 (° C./s) | Coil Size after Coiling: Coil Weight (ton) | Coil Size after Coiling: Coil width (mm) | Coil Size after Coiling: Thickness (mm) | Note |
|---|---|---|---|---|---|---|---|---|---|---|---|---|---|---|
| 9A | 9 | 760 | 1200 | 800 | 60 | 810 | 39 | 581 | 570 | 61 | 33 | 2270 | 22 | Comparative Example |
| 10A | 10 | 744 | 1210 | 806 | 60 | 815 | 38 | 559 | 540 | 48 | 31 | 1810 | 22 | Comparative Example |

*1Cooling start temperature at the central position in the thickness direction
*2Average cooling rate from cooling stat temperature to 650° C. at the central position in the thickness direction
*3Cooling stop temperature at the central position in the thickness direction
*4Coiling temperature at the central position in the thickness direction
*5Average cooling rate from 400° C. to 390° C. at the central position in the width direction of the peripheral surface of a coil

TABLE 3

| Steel Sheet No. | Steel No. | Microstructure of Hot-rolled Steel Sheet: Bainitic Ferrite: Average Grain Diameter (μm) | Bainitic Ferrite: Volume Fraction (%) | Retained Austenite Volume Fraction (%) | Martensite Volume Fraction (%) | Pearlite Volume Fraction (%) | Poly-gonal Ferrite Volume Fraction (%) | Mechanical Property: Hot-rolled Steel Sheet (Width Direction): Yield Strength YS (MPa) | Tensile Strength TS (MPa) | Yield Ratio YR (%) | vTrs (° C.) |
|---|---|---|---|---|---|---|---|---|---|---|---|
| 1A | 1 | 3.0 | 93.2 | 2.7 | 3.0 | 1.1 | 0.0 | 593 | 754 | 79 | −120 |
| 1B | | 2.9 | 93.3 | 0.4 | 5.1 | 1.2 | 0.0 | 580 | 743 | 78 | −120 |
| 2A | 2 | 2.1 | 90.9 | 3.8 | 3.8 | 1.5 | 0.0 | 648 | 868 | 75 | −120 |
| 2B | | 2.7 | 86.7 | 0.8 | 1.1 | 5.2 | 6.2 | 520 | 693 | 75 | −75 |
| 3A | 3 | 3.0 | 93.3 | 3.0 | 2.7 | 1.0 | 0.0 | 575 | 733 | 78 | −130 |
| 3B | | 3.2 | 93.2 | 0.3 | 5.3 | 1.2 | 0.0 | 544 | 725 | 75 | −130 |
| 4A | 4 | 4.2 | 94.8 | 2.1 | 2.5 | 0.6 | 0.0 | 564 | 697 | 81 | −130 |
| 5A | 5 | 2.4 | 92.3 | 3.7 | 3.0 | 1.0 | 0.0 | 629 | 822 | 77 | −120 |
| 6A | 6 | 1.8 | 92.1 | 3.2 | 3.9 | 0.8 | 0.0 | 571 | 732 | 78 | −130 |
| 7A | 7 | 3.1 | 98.9 | 0.3 | 0.3 | 0.5 | 0.0 | 733 | 789 | 93 | −115 |
| 8A | 8 | 4.0 | 97.8 | 0.4 | 0.7 | 1.1 | 0.0 | 700 | 769 | 91 | −120 |
| 9A | 9 | 4.7 | 82.7 | 2.9 | 13.5 | 0.9 | 0.0 | 746 | 857 | 87 | −55 |
| 10A | 10 | 3.8 | 85.7 | 1.5 | 11.8 | 1.0 | 0.0 | 701 | 825 | 85 | −50 |

| Steel Sheet No. | Mechanical Property: Electric Resistance Welded Steel Pipe (Peripheral Direction of Steel Pipe): Yield Ratio (%): 90-Degree $YR_{90}$*6 | Yield Ratio (%): 180-Degree $YR_{180}$*7 | Difference in Yield Ratio ΔYR*8 (%) | Note |
|---|---|---|---|---|
| 1A | 81 | 83 | 2 | Example |
| 1B | 81 | 93 | 12 | Comparative Example |
| 2A | 76 | 82 | 6 | Example |
| 2B | 74 | 85 | 11 | Comparative Example |
| 3A | 82 | 89 | 7 | Example |
| 3B | 79 | 93 | 14 | Comparative Example |
| 4A | 80 | 87 | 7 | Example |
| 5A | 81 | 87 | 6 | Example |
| 6A | 80 | 83 | 3 | Example |
| 7A | 83 | 94 | 11 | Comparative Example |

TABLE 3-continued

| | | | | |
|---|---|---|---|---|
| 8A | 84 | 95 | 11 | Comparative Example |
| 9A | 81 | 85 | 4 | Comparative Example |
| 10A | 85 | 91 | 6 | Comparative Example |

*6Yield Ratio $YR_{90}$ (%) at the position located at 90 degrees in the circumferential direction from the welded part of the electric resistance welded steel pipe which is assumed to be located at 0 degrees
*7Yield Ratio $YR_{180}$ (%) at the position located at 180 degrees in the circumferential direction from the welded part of the electric resistance welded steel pipe which is assumed to be located at 0 degrees
*8ΔYR (%) = $|YR_{90} - YR_{180}|$ As Table 3 indicates, the hot-rolled steel sheets of our examples were good in terms of all of tensile properties (yield strength, tensile strength, yield ratio, and the difference in yield ratio of an electric resistance welded steel pipe) and toughness (low-temperature toughness). In contrast, the hot-rolled steel sheets of the comparative examples were unsatisfactory in terms of one or both of tensile properties and toughness (low-temperature toughness).

The invention claimed is:

1. A hot-rolled steel sheet having a chemical composition containing, by mass %, C: 0.030% or more and 0.120% or less, Si: 0.05% or more and 0.50% or less, Mn: 1.00% or more and 2.20% or less, P: 0.025% or less, S: 0.0050% or less, N: 0.0060% or less, Al: 0.005% or more and 0.100% or less, Nb: 0.020% or more and 0.100% or less, Mo: 0.05% or more and 0.50% or less, Ti: 0.001% or more and 0.100% or less, Cr: 0.05% or more and 0.50% or less, Ca: 0.0005% or more and 0.0050% or less, and the balance being Fe and inevitable impurities, and having a microstructure including bainitic ferrite as a main phase and martensite and retained austenite as second phases, wherein a volume fraction of the main phase is 90% or more, an average grain diameter of the main phase is 10 μm or less, a volume fraction of the martensite is 0.5% or more and 9.5% or less, and a volume fraction of the retained austenite is 0.5% or more and 9.5% or less, wherein the steel sheet has a yield ratio of 90% or less, a yield strength of 555 MPa or more, and a tensile strength of 650 MPa or more and a coil width of 1000 mm or more.

2. The hot-rolled steel sheet according to claim 1, the steel sheet having the chemical composition further containing, by mass %, one or more selected from among V: 0.001% or more and 0.100% or less, Cu: 0.001% or more and 0.50% or less, Ni: 0.001% or more and 1.00% or less, and B: 0.0040% or less.

3. A method of manufacturing a hot-rolled steel sheet according to claim 1, the method comprising: cooling a continuously cast slab having the chemical composition according to claim 1 to a temperature of 600° C. or lower; heating the cooled slab in a temperature range of 1050° C. or higher and 1300° C. or lower; performing rough rolling; performing finish rolling following the rough rolling, wherein rolling reduction in a nonrecrystallization temperature range is 20% or more and 85% or less, and wherein a finishing delivery temperature is equal to or higher than ($Ar_3$−50° C.) and equal to or lower than ($Ar_3$+100° C.); performing cooling following the finish rolling, wherein an average cooling rate at a central position in a thickness direction of the steel sheet is 10° C./s or more and 100° C./s or less in a temperature range from a cooling start temperature to 650° C., and wherein a cooling stop temperature is 420° C. or higher and 650° C. or lower; and performing coiling at 400° C. or higher and 650° C. or lower to obtain a coil having a weight of 20 tons or more and a width of 1000 mm or more.

4. A method of manufacturing a hot-rolled steel sheet according to claim 2, the method comprising: cooling a continuously cast slab having the chemical composition according to claim 2 to a temperature of 600° C. or lower; heating the cooled slab in a temperature range of 1050° C. or higher and 1300° C. or lower; performing rough rolling; performing finish rolling following the rough rolling, wherein rolling reduction in a nonrecrystallization temperature range is 20% or more and 85% or less, and wherein a finishing delivery temperature is equal to or higher than ($Ar_3$−50° C.) and equal to or lower than ($Ar_3$+100° C.); performing cooling following the finish rolling, wherein an average cooling rate at a central position in a thickness direction of the steel sheet is 10° C./s or more and 100° C./s or less in a temperature range from a cooling start temperature to 650° C., and wherein a cooling stop temperature is 420° C. or higher and 650° C. or lower; and performing coiling at 400° C. or higher and 650° C. or lower to obtain a coil having a weight of 20 tons or more and a width of 1000 mm or more.

* * * * *